US005323214A

United States Patent [19]

Kai

[11] Patent Number: 5,323,214

[45] Date of Patent: Jun. 21, 1994

[54] IMAGE FORMING APPARATUS HAVING AN ELECTROSTATIC ACTUATOR

[75] Inventor: Tsukuru Kai, Fujisawa, Japan

[73] Assignee: Ricoh Company, Ltd., Tokyo, Japan

[21] Appl. No.: 102,199

[22] Filed: Aug. 5, 1993

[30] Foreign Application Priority Data

Aug. 5, 1992 [JP] Japan ..... 4-229304

[51] Int. Cl.[5] ..... G03G 15/06; G03G 15/08

[52] U.S. Cl. ..... 355/245; 118/653; 174/261; 361/775; 439/59; 439/77

[58] Field of Search ..... 355/245, 262, 265; 118/653; 364/155; 174/261, 267; 361/775, 785, 791; 439/59, 60, 62, 77, 495, 499

[56] References Cited

U.S. PATENT DOCUMENTS 3,644,661 2/1972 Asar et al. ..... 174/261
3,718,936 2/1973 Rice, Jr. ..... 346/155
3,881,799 5/1975 Elliott et al. ..... 439/816
3,893,128 7/1975 Bäuerlen ..... 346/155
4,899,184 2/1990 Leksell et al. ..... 346/155

*Primary Examiner*—Joan H. Pendegrass
*Attorney, Agent, or Firm*—Oblon, Spivak, McClelland, Maier & Neustadt

[57] ABSTRACT

An electrostatic actuator for forming an electric field for transporting the particles of a developer having a predetermined charge in a predetermined direction. A plurality of stripe-like drive electrodes are continuously formed on only one of opposite sides of a substrate in parallel. Pins are affixed to three electrode terminals and contact every third drive electrode selected in matching relation to the electrode terminals. The three terminals are held on an electrode connector which is fitted on one edge of the substrate. The portions of the pins contacting the drive electrodes are thinner than the portions connected to the electrode terminals.

2 Claims, 9 Drawing Sheets

IMAGE FORMING APPARATUS HAVING AN ELECTROSTATIC ACTUATOR

BACKGROUND OF THE INVENTION

The present invention relates to a copier, facsimile apparatus, printer or similar image forming apparatus and, more particularly, to an image forming apparatus having developer transporting means implemented by an electrostatic actuator which transports the particles of a developer having a predetermined charge in a predetermined direction.

An electrostatic actuator for the above application and implementing toner transporting means for transporting a toner from a developing unit to an image carrier is disclosed in, e.g., Japanese Patent Application No. 195901/1991. Specifically, the toner transporting means in the form of a developing roller has a stationary or unrotatable base roller. A plurality of stripe-like electrodes, or drive electrodes as referred to hereinafter, are formed on the base roller to extend in the axial direction of the roller. The nearby drive electrodes are each connected to particular one of a first to a third electrode terminal to constitute three drive electrode groups. Drive voltages of three different kinds and having a predetermined period are selectively applied to the electrode terminals associated with the three drive electrode groups. As a result, a time-varying electric field is formed in the vicinity of the drive electrodes to sequentially transport a charged toner around the drive electrodes in a predetermined direction.

However, the conventional electrostatic actuator described above is severely restricted in respect of design and expensive.

SUMMARY OF THE INVENTION

It is, therefore, an object of the present invention to provide an image forming apparatus having an electrostatic actuator which suffers from a minimum of restriction in design and inexpensive.

In accordance with the present invention, an electrostatic actuator for forming an electric field for transporting particles of a developer having a predetermined charge in a predetermined direction comprises a substrate on which a plurality of stripe-like electrodes are continuously formed in parallel at a predetermined pitch, a predetermined number of electrode terminals disposed above and traversing the electrodes without contacting each other, contact terminals implemented as projections and affixed to the electrode terminals at one end and contacting the electrodes selected at an interval corresponding to the predetermined number, and a terminal holding member holding the electrode terminals and fitted on one edge of the substrate.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 2:
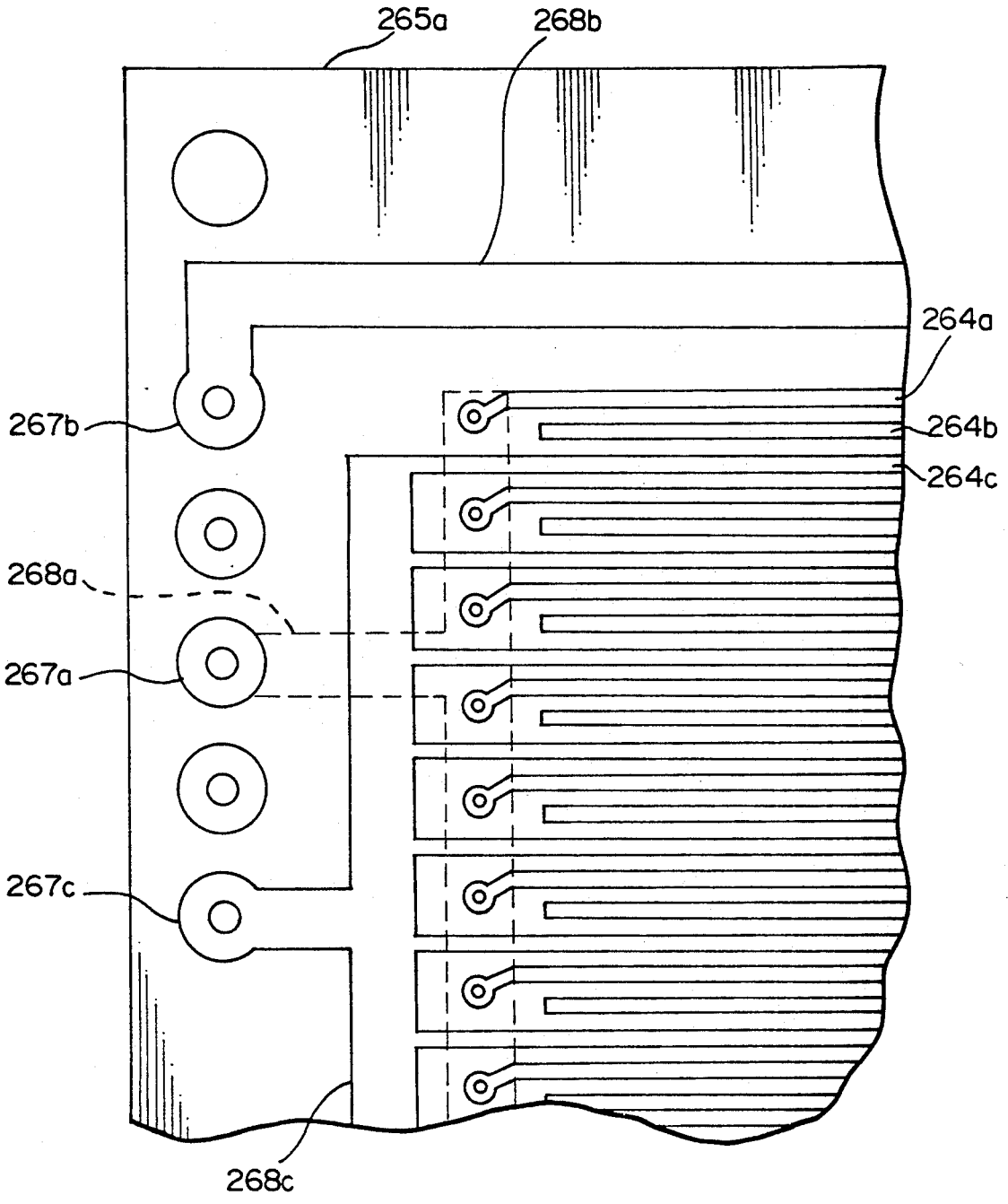
Fig. 2 PRIOR ART
FIG. 2 is a plan view of a substrate included in a conventional electrostatic actuator.

To better understand the present invention, a brief reference will be made to an electrostatic actuator disclosed in previously mentioned Japanese Patent Application No. 195901/1991. FIG. 2 shows a specific drive electrode pattern provided on the electrostatic actuator for experiment. As shown, the actuator has a substrate 265*a* and first drive electrodes 264*a*, second drive electrodes 264*b*, and third drive electrodes 264*c* provided on the substrate 265*a* and to which triphase drive voltages are respectively applied. The first to third drive electrodes 265*a*–265*c* repetitively alternate in this order and constitute a first drive electrode group to a third drive electrode group, respectively. Also provided on the substrate 265*a* are a wiring 268*b* connecting the right end of the second drive electrode group and an electrode terminal 267*b* for the second drive electrodes 264*b*, and a wiring 268*c* connecting the left end of the third drive electrode group and an electrode terminal 267*c* for the third drive electrodes 264*c*. A wiring 268*a* is provided on the rear of the substrate 265*a* to connect the left end of the first drive electrode group and an electrode terminal 267*a* for the first drive electrodes 264*a*, as indicated by a phantom line in the figure.

To form the wirings 268*a*–268*c* and drive electrodes 264*a*–264*c*, a pattern is printed on a two-sided substrate having copper foil on both sides thereof, and then the copper foil is etched. The wiring 268*a* formed on the rear of the substrate 265*a* is electrically connected to the left end of the first drive electrode group formed on the front by through holes, i.e., by forming holes in the substrate 265*a* and then filling them with copper.

A problem with the actuator described above is that to form the wiring 268*a*, the copper foil provided on the rear of the two-sided substrate has to be entirely melted except for the portion to constitute the wiring 268*a*, resulting in wasteful etching. Another problem is that the through holes need additional steps, i.e., perforating the substrate and then pouring copper and, therefore, increases the cost. In addition, the diameter of the through holes cannot be smaller than about 0.5 millimeters in consideration of the surface tension of copper. This prevents the first drive electrodes 264*a* from being formed at a small pitch, and therefore the size of fine particles which the actuator can transport is limited by the pitch.

Moreover, the substrate 265*a* has to be provided with particular dimensions beforehand which match a location where the actuator will be mounted. This, coupled with the fact that the wirings 268*a*–268*c* have to be arranged around the drive electrodes 264*a*–264*c*, causes the dimensions of the electrodes 264*a*–264*c* to be determined by the dimensions of the substrate 265*a*. It follows that to produce several different kinds of substrates, it is necessary to prepare substrates of different sizes corresponding to the desired kinds, and then forming the electrode and wiring pattern substrate by substrate. Such substrates are not feasible for general-purpose application and are expensive.

Figure 3:
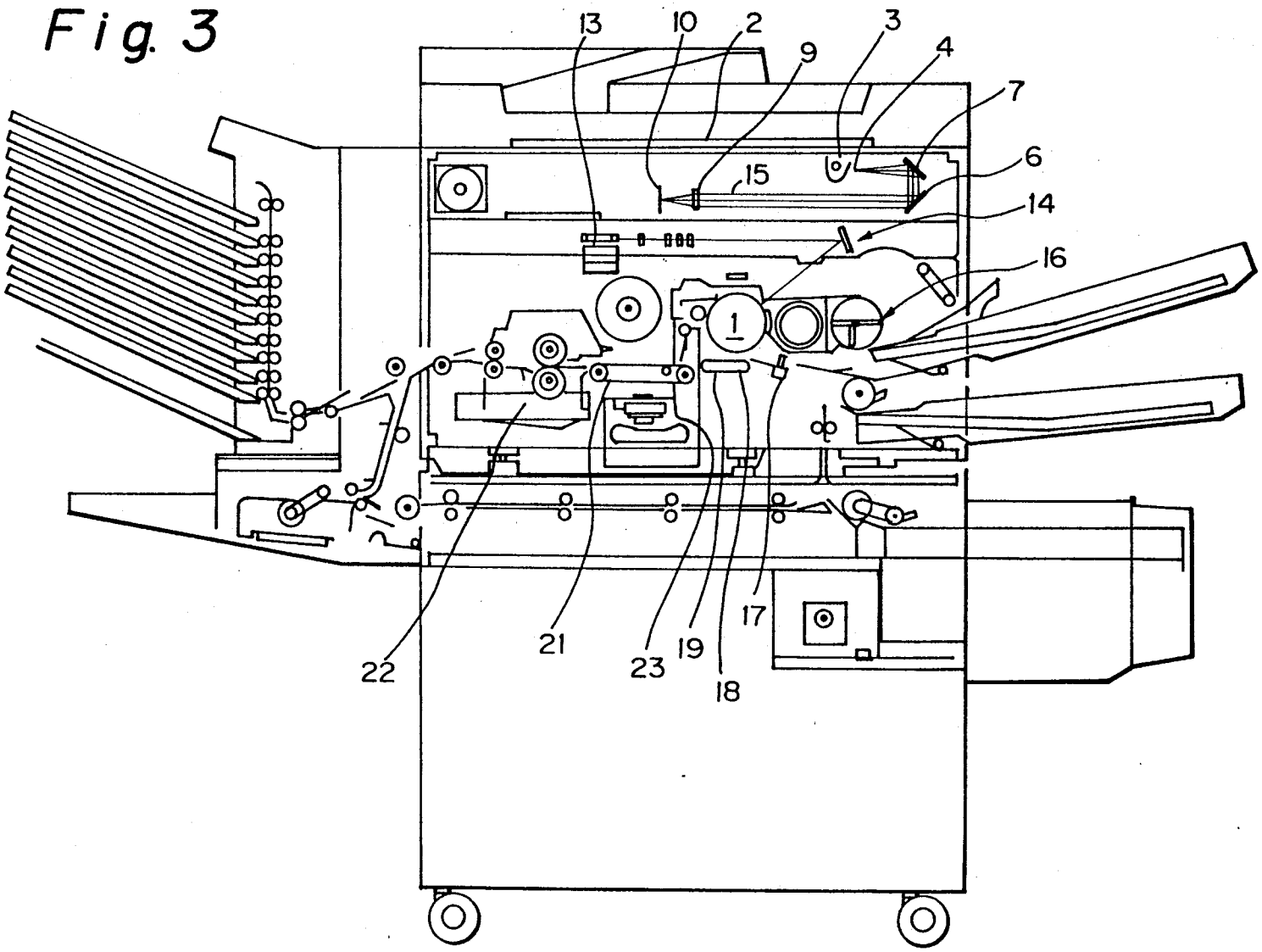
FIG. 3 is a section of a copier to which the embodiment is applied.

Referring to FIG. 3, an image forming apparatus implemented as an electrophotographic copier is shown to which an electrostatic actuator embodying the present invention is applied. As shown, the copier has a photoconductive drum 1 which is a specific form of an image carrier and made of, e.g., an organic photoconductor (OPC). The drum 1 is rotatable counterclockwise as viewed in the figure. After a document has been laid on a glass platen 2, a print switch, not shown, is pressed. Then, scanning optics 5 made up of a light source 3 and a mirror 4 and scanning optics 8 made up of mirrors 6 and 7 are moved to scan the document. The resulting reflection, i.e., imagewise light from the document is incident on an image sensor 10 via a lens 9. The image sensor 10 transforms the incident imagewise light to a corresponding image signal. The image signal is digitized and then processed. The processed image signal drives a laser diode (LD) to cause it to emit a laser beam. The laser beam is reflected by a polygon mirror 13 and then reflected by a mirror 14 to reach the drum 1 whose surface has been uniformly charged by a main charger 15. As a result, a latent image representative of the document image is electrostatically formed on the drum 1. The latent image is converted to a toner image by a developing unit 16. As a sheet is fed from the sheet feed section to the drum 1, the toner image is transferred to the sheet by the corona discharge of a transfer charger 18. The sheet carrying the toner image is separated from the drum 1 by a separation charger 19 and then transported to a fixing roller pair by a belt 21. The fixing roller pair 22 fixes the toner image on the sheet. Finally, the sheet with the fixed toner image is driven out of the copier. The toner remaining on the drum 1 after the image transfer is removed by a cleaning unit 23.

Figure 4:
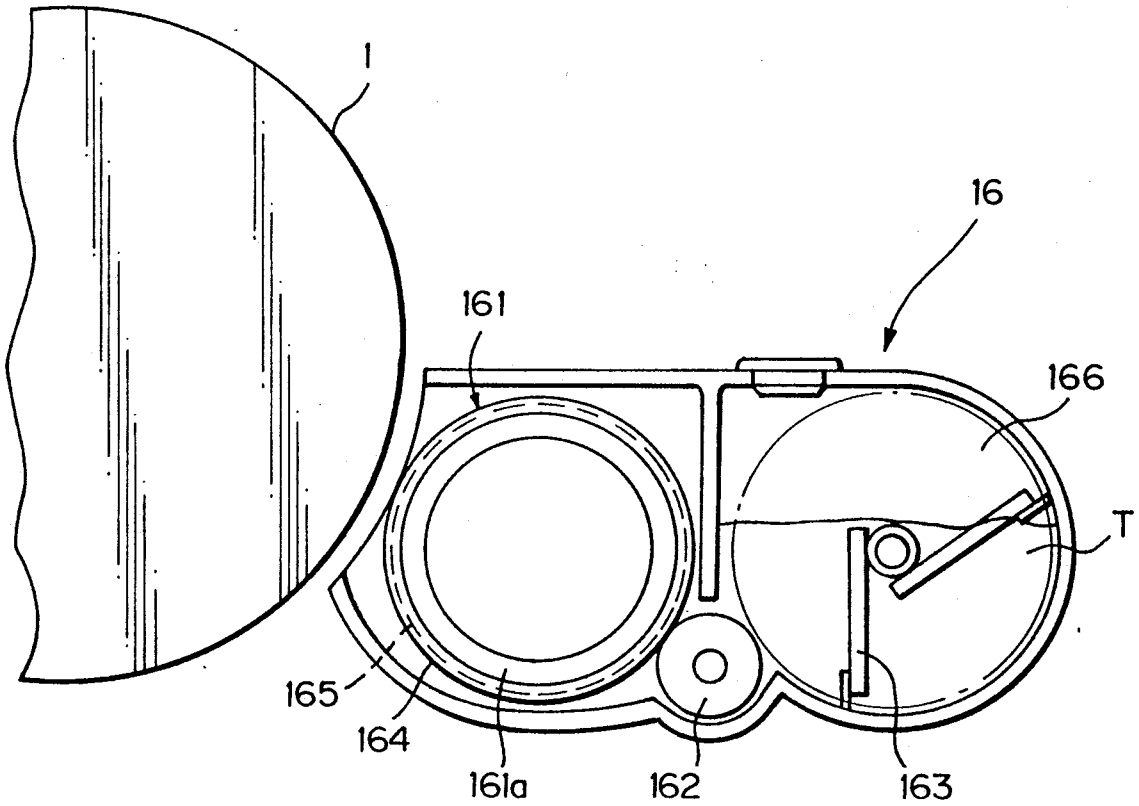
FIG. 4 is a section of a developing unit included in the copier of FIG. 3.

A reference will be made to FIG. 4 for describing the developing unit 16 having toner transporting means which is implemented by the electrostatic actuator embodying the present invention. As shown, the developing unit 16 has a developing roller 161 playing the role of toner transporting means. A charging roller 162 is held in contact with the developing roller 161 and rotated to charge a toner T by friction. An agitator 163 is disposed in a toner hopper 166 for conveying the toner T from the hopper 166 to the vicinity of the charging roller 162. The electrostatic actuator is implemented as a hollow cylinder and provided on a stationary or unrotatable base roller 161*a*. The actuator is made up of, e.g., a stationary body 165, a plurality of drive electrodes 164*a* buried in the body 165, etc. The stationary body 165 consists of a substrate, isulative protection film, etc. The drive electrodes 164*a* have a stripe configuration extending in the axial direction of the base roller 161*a*. Nearby drive electrodes 164 are each connected to particular one of a first to a third electrode terminal 167*a*, 167*b* and 167*c* (see FIGS. 1A and 1B), constituting three drive electrode groups.

The pitch of the drive electrodes 164 as measured in the circumferential direction of the developing roller 161 is selected to be one-third or more of the diameter of toner particles, e.g., about 10 microns to 20 microns. With such a pitch, the drive electrodes 64 will each cause toner particles whose size is about 10 microns to deposit thereon in a single row (see FIGS. 5A–5F). Alternatively, the width of each drive electrode 164 and the pitch of the drive electrodes 164 in the circumferential direction may be increased to cause toner particles to deposit in a plurality of rows on each drive electrode 164.

Specific configurations of the electrostatic actuator will be described in detail later.

The toner T stored in the toner hopper 166 is, e.g., a black toner frictionally charged by the charge roller 162 to a predetermined polarity (positive polarity in the embodiment). The toner T needs to have a predetermined resistance, as will be described. The rotation torque of the agitator 163 is sensed to determine whether or not a toner end condition has been reached. Specifically, when the torque is lowered to below a predetermined value, it is determined that the developing unit 16 has run out of toner, i.e., a toner end condition is reached. This condition is reported to the user by, e.g., turning on a toner end indicator provided on an operation panel, not shown.

Figure 5A:
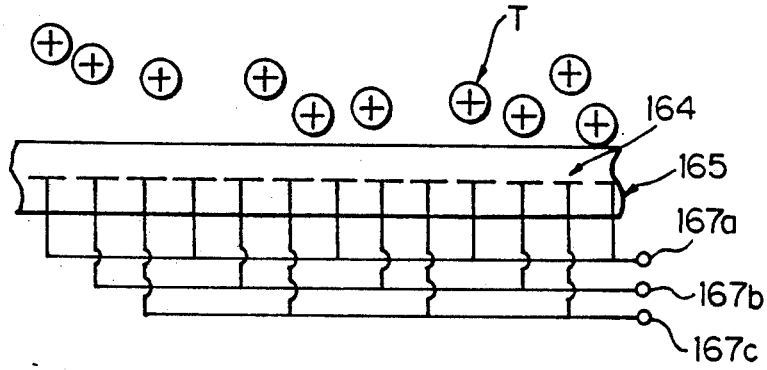
FIGS. 5A to 5F are views demonstrating the principle of toner transport.

Referring to FIGS. 5A–5F, how the actuator transports the toner thereon will be described. In the figures, assume that the actuator transports the toner from the left to the right. As shown in FIG. 5A, so long as no voltages are applied to the terminals 167*a*–167*c*, no charges are deposited on the drive electrodes 164. Although the toner T is frictionally charged by the charging roller 162 to positive polarity, it is not effected by the drive electrodes 164 at all, since not charges exist on the stationary body 165. In this condition, the toner T is floating around the developing roller 161 or is deposited on the body 165 due to some force.

Figure 5B:
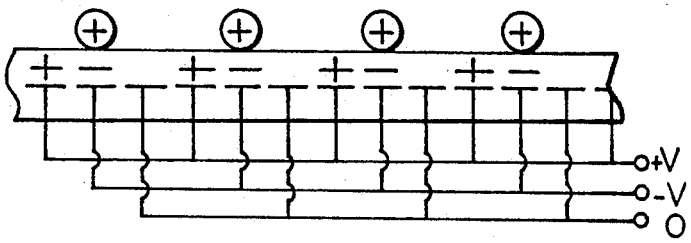

As shown in FIG. 5B, a positive voltage (+V), a negative voltage (−V) and zero volt are applied to the first, second and third terminals 167*a*, 167*b* and 167*c*, respectively. Then, the toner T is electrostatically attracted by the drive electrodes opposite in polarity to the toner T; that is, it is deposited on the surface portions of the developing roller 161 where the drive electrodes 164 receiving −V are positioned. At this instant, the drive electrodes 164 receiving +V and the drive electrodes receiving no voltages do not attract the toner T.

Figure 5C:
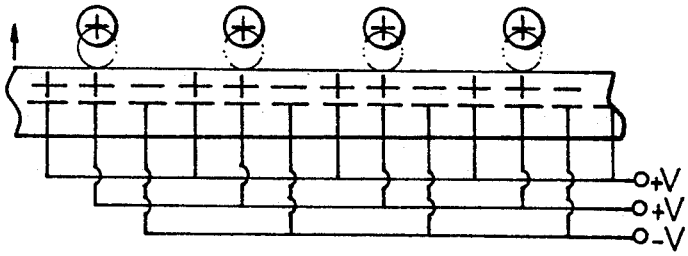
Figure 5D:
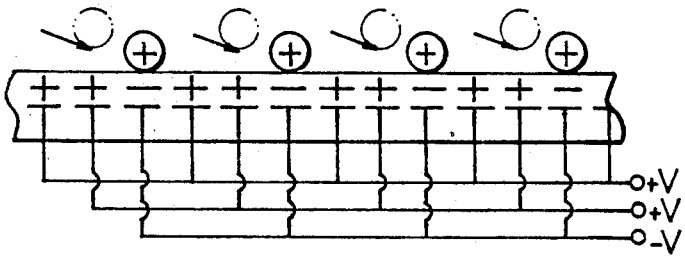

Subsequently, as shown in FIG. 5C, +V identical in polarity as the toner T is applied to the second drive electrode groups underlying the toner T. At the same time, −V opposite in polarity to the toner T is applied to the third drive electrode group adjoining one side (right-hand side in the figures) of the second drive electrode group with respect to the toner transport direction. Further, +V is applied to the first drive electrode group adjoining the other side of the second drive electrode group. Then, the drive electrodes underlying the toner T repulse it, i.e., cause the tone T to float. The third drive electrode group is opposite in polarity to the toner T due to the change from zero volt to −V, so that this group of electrodes attract the toner T floating at the upper left side. Further, the first drive electrode group is of the same polarity as the toner T and, therefore, repulses the toner T floating at the upper right side, thereby driving it to the right. The floating force is successful to reduce the friction between the toner and the surface of the developing roller 161. The driving force due to the charge moves the toner T about one pitch of the drive electrodes to the right, as viewed in the figures.

Figure 5E:
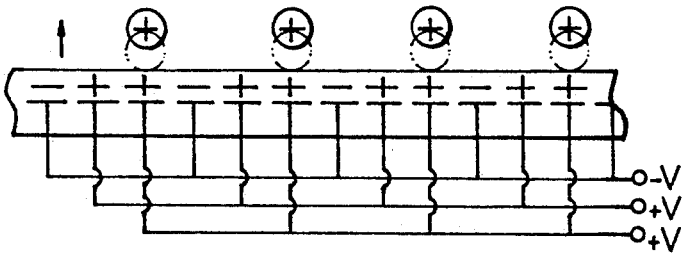
Figure 5F:
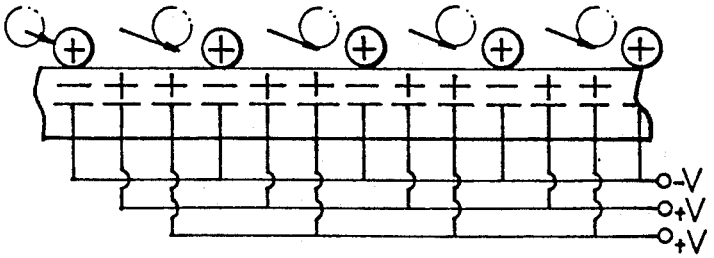

Subsequently, voltages applied to the drive electrode groups are switched over to shift the voltages of the pattern for repulsing and driving the toner T (FIGS. 5C and 5D) by one, as shown in FIGS. 5E and 5F. In this manner, the voltages are applied to the drive electrodes while being sequentially shifted by one so as to continuously move the toner T.

Figure 6:
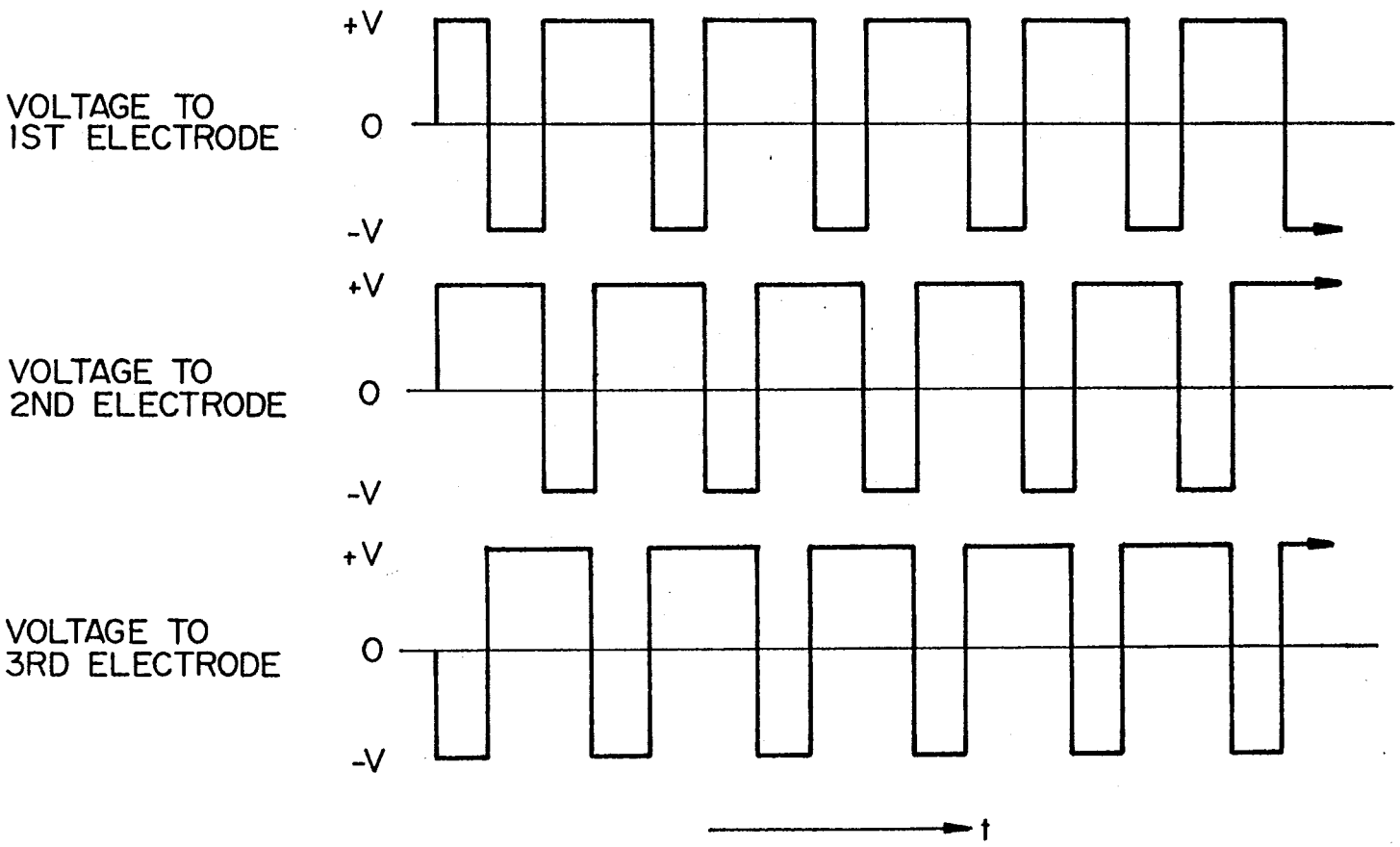
FIG. 6 is a timing chart indicative of voltages to be applied to drive electrode groups.

The procedure shown in FIGS. 5B to 5F and the subsequent switchover of the voltages are listed in Table 1 below and shown in a timing chart in FIG. 6.

TABLE 1

| DRIVE ELECTRODE GOURP | I→ | II→ | III→ | VI→ | ONWARD |
|---|---|---|---|---|---|
| 1ST GROUP | +V→ | +V→ | −V→ | +V→ | repetition of II-IV |
| 2ND GROUP | −V→ | +V→ | +V→ | −V→ | repetition of II-IV |
| 3RD GROUP | O→ | −V→ | +V→ | +V→ | repetition of II-IV |

In Table 1, steps I, II and III correspond to FIG. 5B, FIGS. 5C and 5D, and FIGS. 5E and 5F, respectively. A step IV is indicative of a condition wherein +V, −V and +V are respectively applied to the first, second and third drive electrode groups, i.e., the voltages of the repulsing and driving pattern are shifted from the step III by one to the right. Thereafter, the steps II-IV are repeated to shift the voltages of the repulsing and driving pattern sequentially.

In FIG. 5C (step II), +V and −V may be respectively applied to the third electrode group and the first electrode group so as to drive the toner T in the reverse direction.

Figure 7:
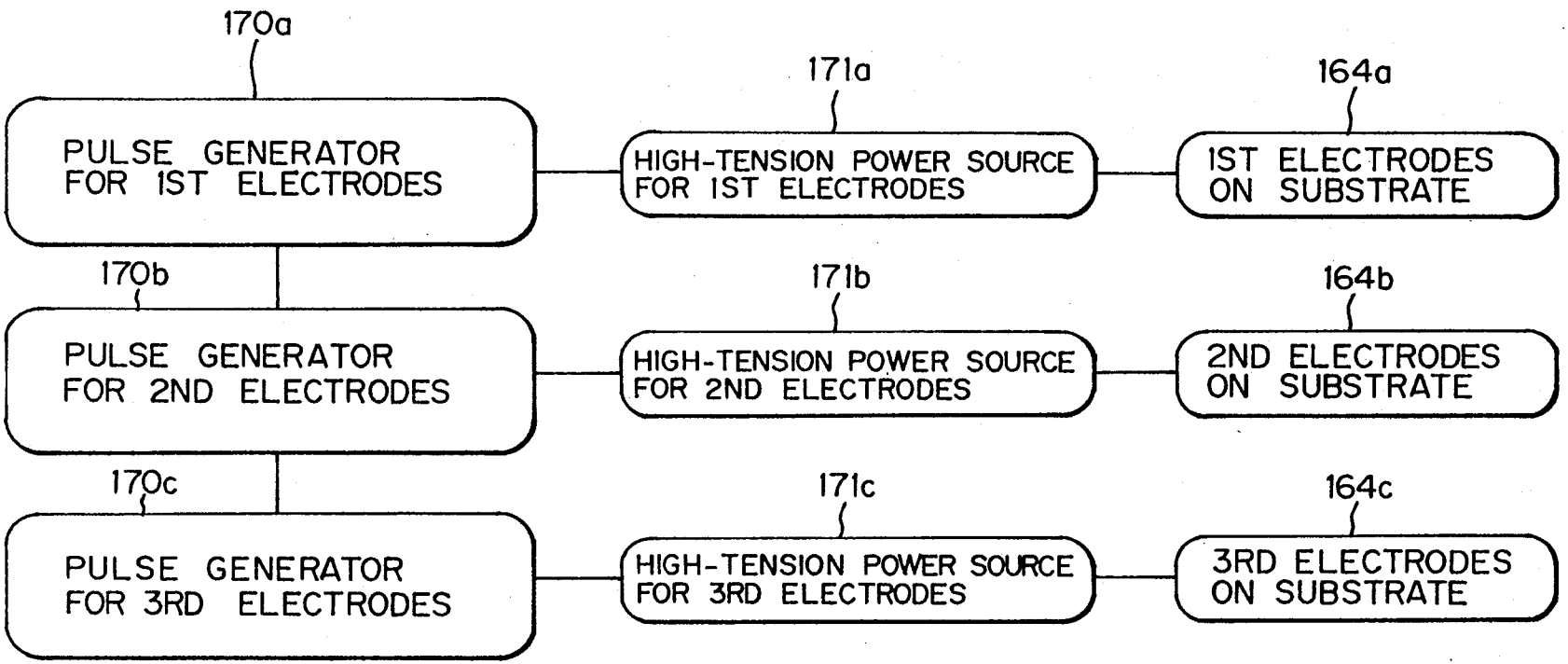
FIG. 7 is a block diagram schematically showing a power source arrangement associated with the drive electrode groups.

FIG. 7 shows a specific power source arrangement for controlling the voltages to the applied to the drive electrodes 164. As shown, pulse generators 170*a*, 170*b* and 170*c* respectively generate pulse signals shown in FIG. 6 which are to be applied to the terminals 167*a*, 167*b* and 167*c*. At this instant, the pulse signals are synchronized as shown in FIG. 6. The pulse signals from the pulse generators 170*a*, 170*b* and 170*c* are respectively amplified by high-tension power sources 171*a*, 171*b* and 171*c* and then applied to the terminals 167*a*, 167*b* and 167*c*. While the absolute values of the voltages (+V and −V) to be applied to the terminals 167*a*-167*c* are generally 3 kilovolts or below, they are changed on the basis of the mass and charge of the toner particles, the pitch of the drive electrodes and so forth, as needed.

In the above construction, the toner T in the toner hopper 166 is conveyed to the charging roller 162 by the agitator 163, charged to a predetermined polarity by the charging roller 162, and then transported to the surface of the developing roller 161. The toner T deposited on the developing roller 161 is conveyed by the electrostatic actuator to a a developing station where the roller 161 faces the drum 1. At this station, the toner T is selectively transferred from the roller 161 to the drum 1 to develop a latent image formed on the drum 1. The toner T left on the roller 161 without depositing on the drum 1 is returned to the developing unit and then removed from the roller 161 by the charging roller 162.

The illustrative embodiment divides the multiple drive electrodes 164 into three groups and causes the toner T to deposit on one of the three groups of drive electrodes. Hence, the toner T is deposited on substantially one-third of the entire circumference of the developing roller 161. It is, therefore, preferable to move the toner T at a speed three times or more higher than the linear velocity of the drum 1 on the developing roller 161, so that a sufficient amount of toner may be supplied to the drum 1 to effect uniform development.

As stated above, the embodiment is applied to the toner transporting means of the developing unit 16 and transports the toner T without rotating the developing roller 161. This eliminates friction otherwise caused by the rotation of the developing roller 161 and, therefore, frees the toner from stresses ascribable to friction. The stresses would cause the toner to stick. Since the developing roller 161 does not rotate, eddy current which would increase the torque is eliminated. In addition, heat generation is suppressed to prevent the toner in the developing unit 16 from melting.

Figure 1A:
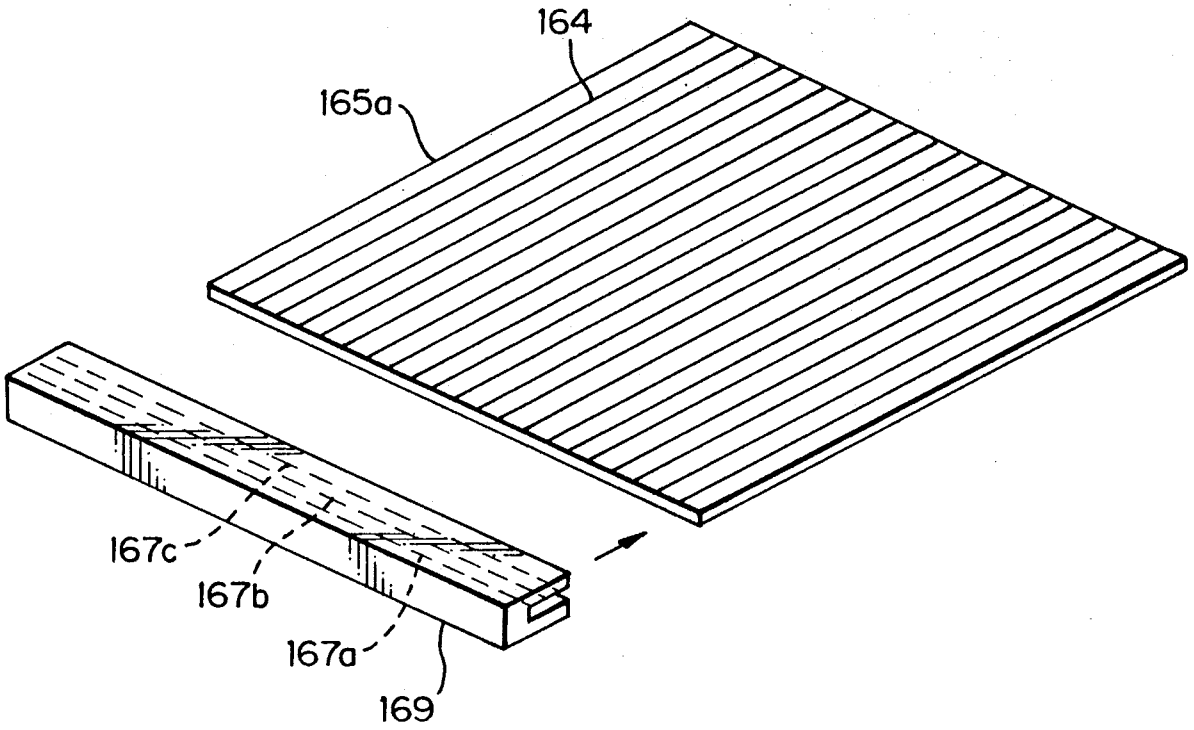
FIG. 1A is an external perspective view of an electrostatic actuator embodying the present invention with a connector not fitted thereon.
Figure 1B:
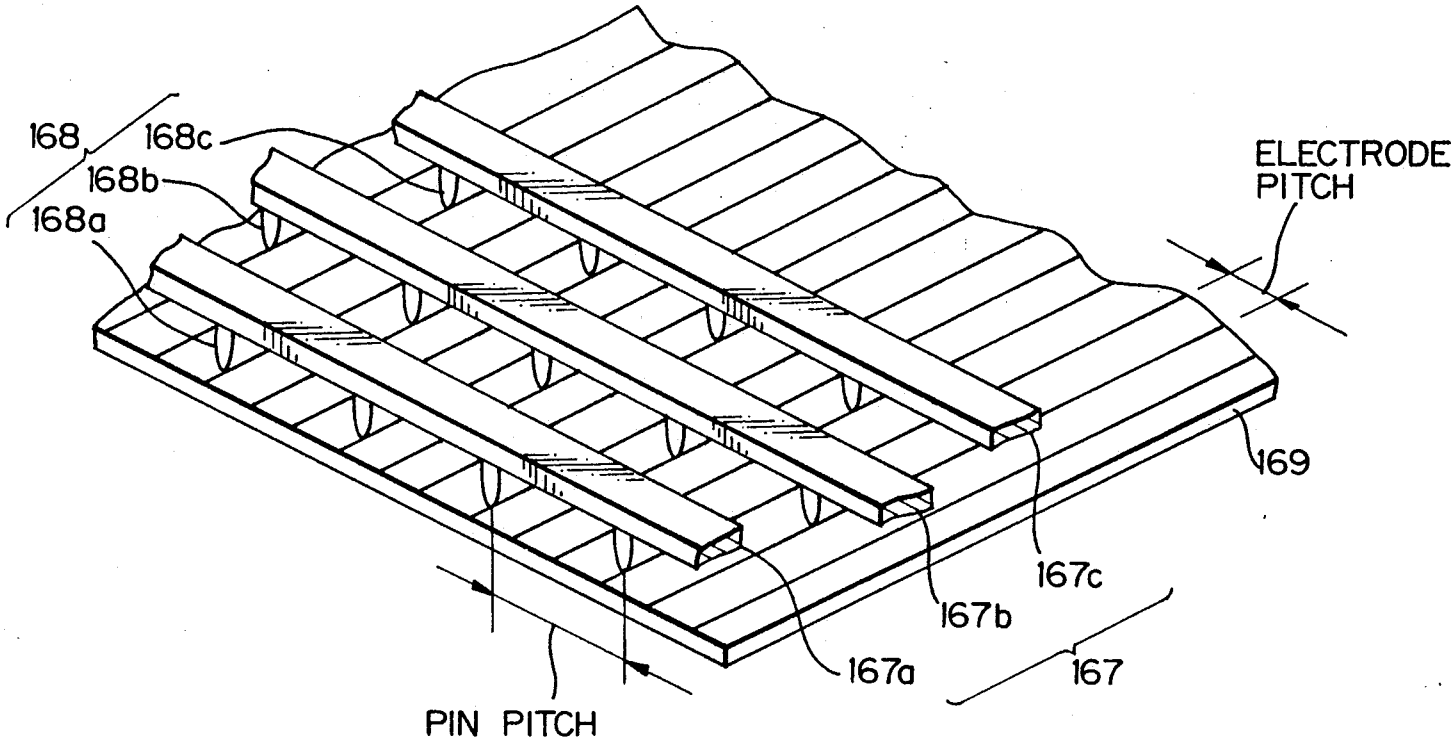
FIG. 1B is an opened-up view showing part of the embodiment with the connector fitted thereon.

Referring to FIGS. 1A and 1B, a specific configuration of the electrostatic actuator in accordance with the present invention is shown. As shown in FIG. 1A, the actuator has a substrate 165*a* provided with the drive electrodes 164 on the surface thereof, an electrode connector 169 provided with the electrode terminals 167*a*-167*c*, or 167 collectively, etc. The substrate 165*a* forms part of the stationary body 165 and may be implemented by an ordinary one-sided substrate, i.e., a laminate substrate of epoxy resin or similar material having copper foil adhered to one side thereof. The elongate drive electrodes 164 are formed on the substrate 165*a* in parallel and perpendicularly to the direction of toner transport. The pitch of the drive electrodes 164 is selected to be one-third or more of the diameter of the charged particles to be transported, e.g., 10 microns to 50 microns.

A specific procedure for forming the drive electrodes 164 is as follows. First, a block copy on which the drive electrodes 164 are drawn at the above-mentioned pitch is prepared. A reverse pattern of the drive electrodes 164 is drawn on the copper foil of the substrate 165*a* by acid-resisting ink on the basis of the block copy. Then, part of the copper foil not protected by the ink is etched and removed by an acid aquarious solution, thereby forming the electrode pattern. To protect the exposed surface of the copper foil, a silicon paint, for example, is applied to the portions of the substrate 165*a* where the drive electrodes 164 are formed. Further, to prevent the drive electrodes 164 from short-circuiting, the portions where they are positioned are covered with an insulating film which also forms part of the stationary body 165. In FIGS. 1A and 1B, the insulating film is not shown to clearly show the configuration of the drive electrodes 164.

Figure 8A:
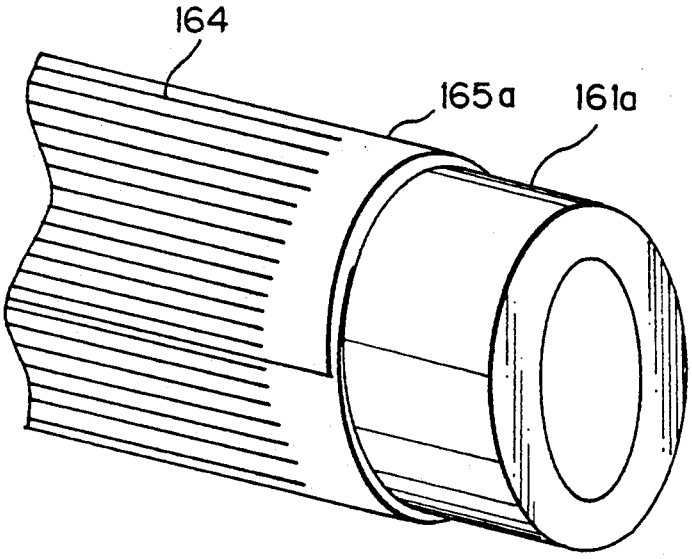
FIGS. 8A and 8B are external perspective views each showing a specific configuration of the actuator in accordance with the present invention.
Figure 8B:
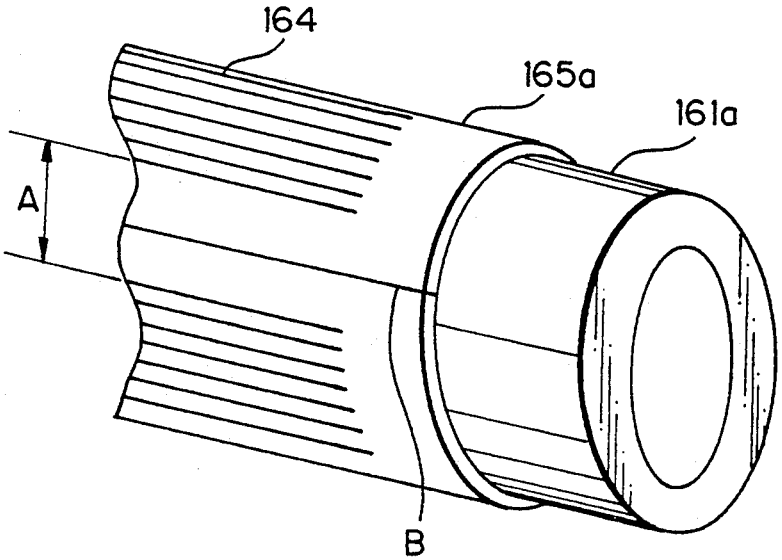

To form a hollow cylindrical actuator, the substrate 165*a* may be implemented as a flexible substrate. When the hollow cylindrical actuator is to be fitted on, e.g., the base roller 161*a* of the developing roller 161, it may be provided with an overlapping endless configuration, as shown in FIG. 8A. Alternatively, as shown in FIG. 8B, the actuator may be provided with a portion A for releasing the toner returned from the developing station to the interior of the developing unit 16 from the developing roller 161. In FIG. 8B, labeled B is a seam where opposite edges of the actuator are joined together. The actuator may be fitted on the base roller 161*a* by ordinary adhesion or by the steps of wrapping it around the base roller 161*a*, covering it with a thermally shrinkable insulating sheet, and then heating the assembly.

The electrode connector 169 is fabricated by machining an insulator of plastic or similar material. In FIG. 1A, the connector 169 is so configured as to be fitted on the flat substrate 165*a*. The electrode terminals 167 in the form of metallic bars are buried in the connector 169, as indicated by phantom lines in FIG. 1A. As shown in FIG. 1B, the terminals 167 are oriented to traverse the drive electrodes 164. Pins 168 are affixed to one side of the terminals 167 which faces the drive electrodes 164 and spaced apart in the longitudinal direction of the terminals 167. The pins 168 are made of copper or similar conductor and serves as contact terminals. The pitch of the pins 168 is such that they contact every third drive electrode 164. For example, when the pitch of the drive electrodes 164 is 50 microns, the pitch of the pins 168 is 150 microns.

Each pin 168 has a conical shape which is slightly thickened at the intermediate portion. The pin 168 is affixed to the terminal 167 at the thicker portion thereof and held in contact with the surface of the drive electrode 164 at the tip thereof. Preferably, the insulating film should not be provided on part of the drive electrodes 164 which the pins 168 contact in order to insure electrical connection. For this purpose, the insulating film may not be provided at all or may be formed on the entire substrate 165*a* carrying the drive electrodes 164 and then removed at portions which the pins 168 will contact. It is to be noted that in FIG. 1B the connector 169 is not shown to clearly show the arrangement of the terminals 167 and pins 168.

As shown in FIG. 1B, each of the three drive electrode groups is constituted by the electrodes 164 spaced apart at an interval of two electrodes 164. All the drive electrodes 164 are divided into the first to third drive electrode groups 164*a*–164*c*. The electrode terminals 167*a*–167*c* are assigned to the drive electrode groups 164*a*–164*c*, respectively. The pins 168*a* provided on the terminal 167*a*, the pins 178*b* provided on the terminal 167*b*, and the pins 168*c* provided on the 167*c* are held in contact with the drive electrode groups 164*a*, 164*b* and 164*c*, respectively.

As shown in FIG. 1A, the electrode connector 169 is fitted on one edge of the substrate 165*a* in a direction indicated by an arrow A. At this instant, the connector 169 is positioned such that the tip of each pin 168 contacts the center of the associated drive electrode 164. For this purpose, positioning means may be provided for causing the tips of the pins 168 to constantly contact the center of the associated drive electrodes 164. For example, the edge of the connector 169 facing the edge of the substrate 165*a* may be configured to receive the latter.

Connection terminals, not shown, are also provided on the electrode connector 169 and connected to the high-tension power sources 168*a*–168*c*, FIG. 7. High tension-voltages are applied to the associated drive electrodes 164*a*–164*c* via the connection terminals, electrode terminals 167 and pins 168 at the timing shown in FIG. 6.

When the actuator is provided with a hollow cylindrical configuration, the electrode connector 169 is also provided with an annular configuration. Specifically, the annular connector 169 is fitted on one edge of the hollow cylindrical substrate 165*a* to bring the tips of the pins 168 into contact with the surfaces of the drive electrodes 164.

As stated above, in the specific configuration, the multiple stripe-like drive electrodes 164 are formed on only one side of the substrate 165*a* in parallel. The pins 168 are affixed to the three electrode terminals 167*a*–167*c* to contact the drive electrode groups 164*a*–164*c*. The electrode connector 169 holding the terminals 167*a*–167*c* at spaced positions is fitted on one edge of the substrate 165*a*. The substrate 165*a*, therefore, can be implemented by a substrate carrying copper foil on only one of opposite sides thereof, eliminating the need for etching the rear of the substrate. This, coupled with the fact that through holes for the electrical connection of the front and rear of the substrate is not necessary, implements an electrostatic actuator easily at low cost. Moreover, the pitch of the drive electrodes 164 can be reduced since through holes are absent.

It is not necessary to determine the dimensions of the substrate 165*a* or the drive electrode and terminal pattern beforehand. All that is required is to form the drive electrodes 164 on the entire area of one side of the substrate 165*a* having a relatively large size at a predetermined pitch, and then cut the substrate 165*a* in a particular size matching a location where the actuator should be arranged. This allows the shape of the substrate 165*a* to be freely designed, provides the substrate 165*a* with a broad range of applicability and allows the substrate 165*a* to be fabricated easily at low cost.

The portions of the pins 168 which contact the drive electrodes 164 are thinner than the portions which are connected to the electrode terminals 167. Hence, only the tips of the pins 168 contact only the associated drive electrodes 164, so that drive voltages can be accurately applied to the electrodes 164. Further, if the pins 168 are so positioned as to penetrate into the drive electrodes 164, the electric resistance at their contacting surfaces is reduced to insure electrical connection. As a result, designed drive voltages can be surely applied to the drive electrodes 164.

While the embodiment has been shown and described in relation to the toner transporting means of the developing unit 16, it may be implemented as toner supplying means associated with the cleaning unit 23 for transporting the removed toner to the developing unit 16 for reuse. Specifically, in FIG. 3, the toner remaining on the drum 1 after image transfer is collected by the cleaning unit 23. This part of the toner is returned to the developing unit 16 by, e.g., a coil disposed in a piping which communicates the cleaning unit 23 to the developing unit 5. In this case, the electrostatic actuator will be located at the position where the cleaning unit 23 and the piping join each other. Specifically, the actuator will extend from the bottom of the casing, not shown, of the cleaning unit 23 to the lower surface of the piping adjacent to the joining portion.

The illustrative embodiment is practicable with either of a toner of high resistance and a toner of medium resistance so long as it can be charged by friction. However, the prerequisite with the toner of medium resistance is as follows. Assume that the polarities of the voltages being applied to the drive electrodes are switched over when the toner is deposited on the portions of the developing roller 161 overlying the drive electrodes. Then, the charges of the drive electrodes deposited just after the switchover are apt to induce charges opposite in polarity to the toner at the bottom of the toner. Then, the charges of the drive electrodes would attract the toner to prevent a sufficient repulsive force from being generated. The prerequisite is, therefore, that the medium resistance be of a degree generating a sufficient repulsive force in the event of switchover of the polarities of the voltages.

In the embodiment, the toner is used after being charged by friction. The embodiment is also capable of transporting a non-charged toner. Specifically, to transport a non-charged toner, after charges opposite in polarity to the voltages applied to the drive electrodes have been induced below the toner in the condition shown in FIG. 5B, the voltages are switched over as shown in FIG. 5C to generate a repulsing force to move the toner, as in the embodiment. Again, the charges of the drive electrodes deposited just after the switchover are apt to induce charges opposite in polarity to the toner at the bottom of the toner. Then, the charges of the drive electrodes would attract the toner to prevent a sufficient repulsive force from being generated. Therefore, the medium resistance should be of a degree generating a sufficient repulsive force in the event of switchover of the polarities of the voltages.

While the embodiment applies triphase voltages of predetermined phases and predetermined period to the first to third drive electrodes 164*a*–164*c*, the present invention is practicable even with voltages having two or four phases.

In summary, it will be seen that the present invention provides an image forming apparatus having an electrostatic actuator achieving the various unprecedented advantages as described in relation to the embodiment.

Various modifications will become possible for those skilled in the art after receiving the teachings of the present disclosure without departing from the scope thereof.

What is claimed is:

1. An electrostatic actuator for forming an electric field for transporting particles of a developer having a predetermined charge in a predetermined direction, said actuator comprising:

a substrate on which a plurality of stripe-like electrodes are continuously formed in parallel at a predetermined pitch;

a predetermined number of electrode terminals disposed above and traversing said plurality of electrodes without contacting each other;

contact terminals implemented as projections and affixed to said electrode terminals at one end and contacting said electrodes selected at an interval corresponding to said predetermined number; and a terminal holding member holding said electrode terminals and fitted on one edge of said substrate.

2. An actuator as claimed in claim 1, wherein portions of said contact terminals contacting said electrodes are thinner than portions of said contact terminals affixed to said electrode terminals.

* * * * *